United States Patent [19]

Dobbins

[11] Patent Number: 4,867,039

[45] Date of Patent: Sep. 19, 1989

[54] COMBINATION PUMP ACTION AUTOLOADING RIFLE AND SHOTGUN

[75] Inventor: David R. Dobbins, Reston, Va.

[73] Assignee: Special Service Arms Mfg. Inc., Edgefield, S.C.

[21] Appl. No.: 172,240

[22] Filed: Mar. 23, 1988

[51] Int. Cl.[4] ..... F41D 11/02; F41D 10/32

[52] U.S. Cl. ..... 89/127; 42/18; 89/1.41; 89/33.1; 89/145; 89/146; 89/148

[58] Field of Search ..... 42/42.01, 18, 22; 89/1.41, 126, 127, 33.04, 33.10

[56] References Cited

U.S. PATENT DOCUMENTS

| | | | |
|---|---|---|---|
| 303,262 | 8/1884 | Burgess | 42/18 |
| 993,175 | 5/1911 | Knotgen | 89/126 |
| 1,202,707 | 10/1916 | Grieco | 89/126 |
| 1,290,849 | 1/1919 | Sturgeon | 89/33.01 |
| 2,041,015 | 5/1936 | Onorati | 89/126 |
| 2,410,848 | 11/1946 | Waltke | 89/126 |
| 2,908,987 | 10/1959 | Allyn | 42/18 |
| 2,935,915 | 10/1960 | Janson | 89/193 |
| 3,442,173 | 5/1969 | Muller | 89/127 |
| 4,003,292 | 1/1977 | Christakos | 89/145 |

FOREIGN PATENT DOCUMENTS

| | | | |
|---|---|---|---|
| 371416 | 4/1932 | United Kingdom | 89/126 |

*Primary Examiner*—Stephen C. Bentley

*Attorney, Agent, or Firm*—Birch, Stewart, Kolasch & Birch

[57] ABSTRACT

A semiautomatic gun which can be used to fire two types of ammunition comprises first and second bolts and a selector assembly operated by a user of the gun. The selector assembly selectively permits loading and firing of one type of ammunition. The gun has only a single trigger for firing either of the bolts selected by the selector assembly and the gun may be a combination of a shotgun and rifle or any other desired configuration. Each of the bolts are movable in a forward and rearward direction when fired and have bolt lock-up bearings for preventing such movement at other times. A reciprocable forestock is provided with a forestock lock release. The forestock can be pumped by the operator to initially load a round of ammunition into the chamber selected by the selector assembly. A bolt selector block is also provided which is connected to the forestock and which catches a bolt lug of a bolt selected by the selector assembly whereby the selected bolt may be engaged by the block and moved rearwardly to permit insertion of ammunition. A gas tube is also operatively connected to the bolt selector block to move the block rearwardly whereby loading of ammunition may automatically be carried out after a first round is fired. Additionally, a feeder is provided for supplying ammunition to a position adjacent either of the chambers.

17 Claims, 9 Drawing Sheets

COMBINATION PUMP ACTION AUTOLOADING RIFLE AND SHOTGUN

BACKGROUND OF THE INVENTION

1. FIELD OF THE INVENTION

The present invention relates to a semiautomatic gun which can be used to fire two types of ammunition, shotgun shells and rifle shells, for example. This gun includes a single trigger, a selector means for determining which type of ammunition to fire, a bolt selection means for operating the selected bolt and an ammunition feeder means.

2. DESCRIPTION OF THE BACKGROUND ART

Various semiautomatic guns are known in the prior art. Most of these arrangements do not provide for a gun which may fire either a rifle or shotgun shell or any desired combination thereof by using a single trigger with a selector means. Further, reloading problems and jamming often occur in prior art arrangements.

Accordingly, a need in the art exists for a simple and effective semiautomatic gun which is easy to operate and which loads semiautomatically and which may fire a selected type of ammunition. This device should be capable of being fired without requiring an operator's hands from moving away from the firing position. Such a gun can therefore be more readily operated than other prior art arrangements.

SUMMARY OF THE INVENTION

Accordingly, it is the primary object of the present invention to provide a semiautomatic gun which can shoot the same type or two types of ammunition from separate chambers.

It is another object of the present invention to provide a semiautomatic gun which does not require an operator to move his or her hands from the firing position when selecting which chamber to fire or when loading ammunition to the chamber.

It is a further object of the present invention to provide a semiautomatic gun which avoids jamming, can be easily cleared of a jam or defective ammunition, and may be continuously fired.

Yet another object of the present invention is to provide a semiautomatic gun which is easily and assuredly loaded.

Another object of the present invention is to provide a semiautomatic gun which may be safely carried without a round in either chamber, yet, may be selectively charged for the firing of the desired ammunition.

It is a further object of the present invention to provide a semiautomatic gun which is suitable for us in firing at objects at close or long distance by merely operating the selector means to alternate which type of ammunition is to be fired.

It is another object of the present invention to provide a semiautomatic gun which is compact and easily manufactured and has few moving parts.

A further object of the present invention is to provide a semiautomatic gun which may be easily operated, maintained and manufactured.

These and other objects of the present invention are fulfilled by providing a semiautomatic gun comprising a first chamber and a first bolt, said first bolt firing a first type of ammunition from said first chamber, a second chamber and second bolt, said second bolt firing a second type of ammunition from said second chamber, a trigger, selector means for enabling the trigger to selectively fire one of said first bolt and said second bolt. The selector means comprises a movable switch operable by a user of said gun for selecting one of said bolts, and a sear activator means for selectively interengaging a portion of said trigger to one of said bolts. The sear activator means has at least three surfaces engageable with said portion of said trigger when said trigger is pulled. The first section of said sear activator means prevents firing of any of said bolts when said trigger is pulled. The second surface is engageable by said portion of said trigger and permits said first bolt to be fired. The third surface is engageable by said portion of said trigger and permits the second bolt to be fired. The housing means contains and reciprocates the sear activator means and is reciprocated by movement of said switch whereby said sear activator means may be reciprocated in order for said portion of said trigger to be engaged with one of said three surfaces when said trigger is pulled. Feeder means are also provided for supplying said first and second types of ammunition to said chambers.

These and other objects of the present invention are also fulfilled by providing a semiautomatic gun comprising; a fist chamber and a first bolt, said first bolt firing a first type of ammunition from said first chamber; a second chamber and second bolt, said second bolt firing a second type of ammunition from said second chamber; a trigger; a selector means for enabling said trigger to selectively fire one of said first bolt and said second bolt; feeder means for supplying said first and second type of ammunition to said chambers; bolt selection means and guide means. The bolt selection means is responsive to said selector means for selectively engaging one of said bolts in response to said selector means selecting a bolt. The bolt selection means engages the same bolt as that selected by said selector means and the bolt selection means is reciprocable such that rearward movement of this means moves the selected bolt rearwardly when engaged therewith. The guide means guides the bolt selection means during reciprocation.

Furthermore, these and other objects of the present invention are fulfilled by providing a semiautomatic gun comprising, a first chamber and a first bolt, said first bolt firing a first type of ammunition from said first chamber, a second chamber and second bolt, said second bolt firing a second type of ammunition from said second chamber, a trigger, selector means for enabling said trigger to selectively fire one of said first bolt and said second bolt, and feeder means for supplying said first and second types of ammunition to said chambers. The feeder means further comprises a first magazine well for receiving a first magazine containing the first type of ammunition. A first action insertion means for moving individual rounds of said first type of ammunition from said first magazine to a position adjacent said first chamber is provided. Each of the rounds is moved in at least a generally horizontal, lateral direction by said first action insertion means. A second magazine well located adjacent said first magazine well is also provided for receiving a second magazine containing said second type of ammunition.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
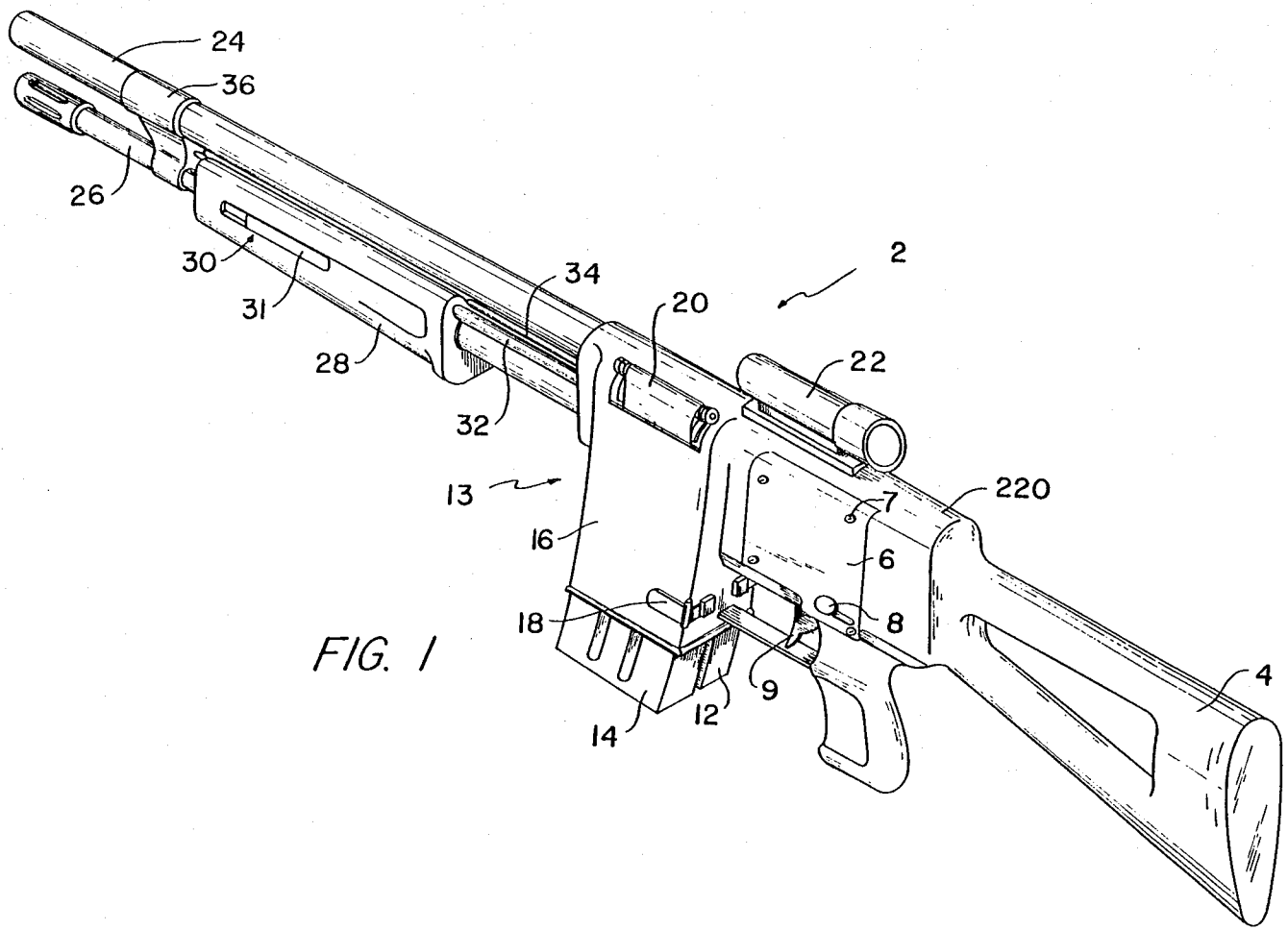
FIG. 1 is an oblique view of the semiautomatic gun of the present invention.

Referring in detail to the drawings and with particular reference to FIG. 1, a combination pump action, autoloading rifle and shotgun is shown. This semiautomatic gun 2 will be described hereinafter as firing either shotgun shells or rifles shells. However, it should be understood that this gun may be used for firing both shotgun shells or for firing both rifle shells or any other combination of ammunition as desired.

The automatic gun 2 includes a butt stock 4, a removable side panel 6 and attachment means 7 for holding panel 6 to the receiver 220. A selector switch 8 is provided on the side of the removable panel 6 and will be discussed hereinafter.

A trigger 9 is provided on the semiautomatic gun 2 for firing either shotgun shells or rifle shells. A feeder means 13 is provided for receiving a rifle magazine 12 and a shotgun magazine 14. As seen in FIG. 1, a shotgun magazine well 16 is provided for receiving the shotgun magazine 14. The well for receiving the rifle magazine is beside the shotgun magazine 14 in FIG. 1. At an upper portion of the shotgun magazine well 16, a first action insertion means or upper action ammunition feeder 20 is provided. This first action insertion means will be described later. Magazine releases 18 are also provided on the feeding means 13 for holding the magazines within the wells.

The semiautomatic gun 2 further includes a sight 22, shotgun barrel 24 and rifle barrel 26. At the forward part of the semiautomatic gun 2 a forestock 28 is provided with a forestock sliding block release 30. Extending between the forestock and the receiver, two spring action rod housings 32 (only one of which is shown in FIG. 1) are provided. A gas tube 34 as well as a gas port block 36 are also provided. The operation of these elements will also be described hereinbelow.

Figure 2:
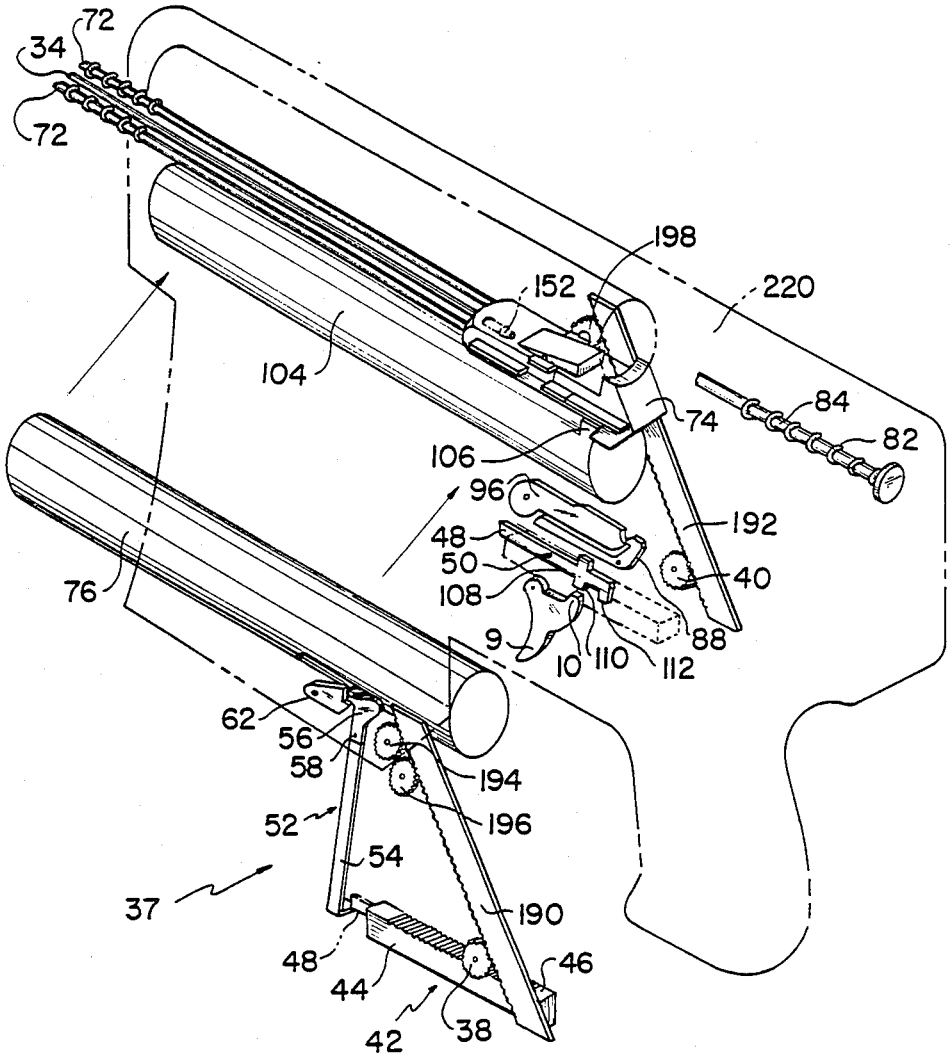
FIG. 2 is an oblique, partially exploded view of the selector means of the present invention.

Operation of the selector switch 8 will enable a user of the semiautomatic gun to select which type of ammunition to be chambered and fired from the gun. Firing of the ammunition is carried out from the single trigger 9. The selector switch 8 can be moved from a safety to a second or lower bolt (rifle) firing position to a first or upper bolt (shotgun) firing position. Referring to FIG. 2, operation of the selector means 37 will be described. This means 37 includes a first selection switch gear 38 and a second selection switch gear 40. These two gears are interconnected by a rod (not shown) with the selector switch 8. While the selector switch 8 is located externally of receiver 220, these gears 38 and 40 are located internally of the receiver and are accessible by removing the side panel 6.

Movement of the first and second selector gears 38 and 40 by switch 8 will cause movement of the fire selector group 42. This fire selector group 42 has a fire selection group housing means 44 with a top surface 46 having a rack which interengages with the teeth of the first and second selection switch gears 38, 40.

Housed within the fire selection group housing means 44, is a sear activator means 48. While FIG. 2 shows a fire selection group housing means 44 and a sear activator means 48 in both solid line and dotted line, it should be understood that only one of each of these means are used. The dotted positions are merely to indicate the overlap of the exploded structure.

The sear activator means 48 has a pivot point 50 for pivotable movement. This point 50 is movable with the fire selection group housing means 44 whereby the sear activator means 48 is both pivotable and longitudinally reciprocable.

An end of the sear activator means 48 engages to the upper sear release bar 52. This release bar 52 includes a lower portion 54 and a top or head portion 56. These two portions are interconnected by a pivot 58.

Figure 3:
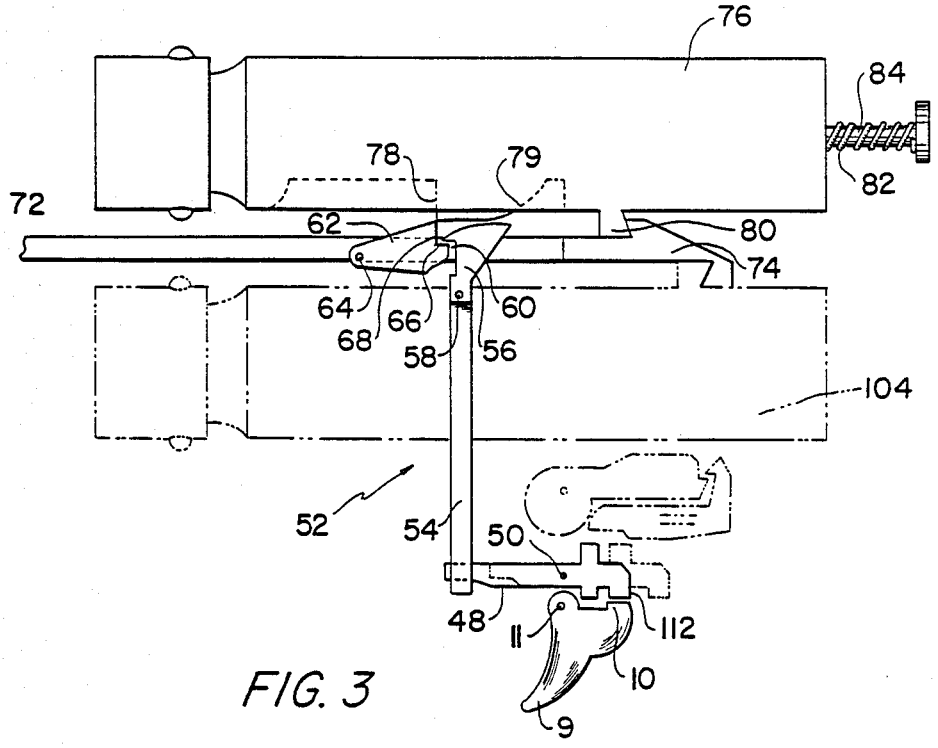
FIG. 3 is a side view of a portion of the selector means for operating the first bolt.

The top portion 52 of the upper sear release bar 52 has a lip 60 as seen in FIG. 3. This lip 60 normally contacts the first or upper action sear 62. A pivot 64 is provided for the upper action sear. An engagement portion 66 is provided on the upper action sear 62 for engaging the lip 60 of head 56. This engagement provides a means of pivoting the action sear 62 in a clockwise direction. Means (not shown) are provided for biasing this upper action sear 62 in a counter-clockwise direction about pivot 64.

The upper action sear 62 includes an engagement portion 68 for engaging the face 78 of the striker of the upper or first bolt 76. This engagement will hold the upper bolt striker 130 in position despite the forward biasing of spring 82. The spring 82 surrounds on upper action spring guide rod 84. The upper bolt 76 further has a bolt lug 80 which interacts with the bolt selection block 74 as will be described hereinbelow. This bolt selection block 74 has twin action rods 72 which will also be described hereinbelow.

Referring to FIG. 3, operation of the selector means in activating the upper action sear 62 will now be described. Movement of the selector switch 8 to a first position rotates the first and second selection switch gears 38, 40 resulting in the fire selection group 42 moving with the fire selection group housing means 44 to a position wherein the sear activator means 48 will be in a position as shown in FIG. 3. In this position, the sear activator means 48 will have a sear activator contact point 112 which will engage a trigger contact surface 10 of the trigger 9 when the trigger 9 is pulled. Thus, when trigger 9 is pulled, this trigger will rotate about trigger pivot 11 and will engage the sear activator contact point 112 through trigger contact surface 10.

Engagement of the sear activator contact point 112 will cause the sear activator means 48 to pivot about point 50. This movement will cause the upper sear release bar 52 to move vertically such that the head portion 56 will be lowered. Lowering of this head portion causes the upper action sear 62 to pivot clockwise about pivot 64 due to the interengagement of lip 60 of the top portion 56 and engagement point 66 of the upper action sear 62.

This pivoting of the upper action sear 62 will eventually disengage the engagement face 68 of sear 62 from the face of the striker 78 resulting in the striker moving in a forward direction (the left hand direction of FIG. 3), firing the round in the upper chamber which will be described hereinbelow. Upon firing, the bolt 76 will be moved in a rearward direction causing it to contact the upper portion of head 56 by a lower surface 79 of the face of the striker 78. This interengagement will cause the head 56 of the upper sear release bar 52 to pivot about point 58. This movement will release the interengaging lip 60 and engagement portion 66 allowing the upper action sear 62 to pivot in a counter-clockwise direction. This pivoting will cause engagement portion 68 to re-engage the face 78 of the striker and thereby hold the striker in the rearward position. Thus, firing of the upper bolt 76 is provided for in this manner.

Now referring to FIG. 4, the firing of the second or lower bolt 104 will be described. A lower action sear 88 is provided with a lower action sear pivot 90 and an internal spring indicated at 92. This internal spring will bias the lower action sear 88 in the forward direction (the left hand direction of FIG. 4). The lower action sear 88 further includes a catch 94 for engaging hammer 96. This hammer 96 is pivotable and is urged in a counter-clockwise direction about point 98.

Figure 4:
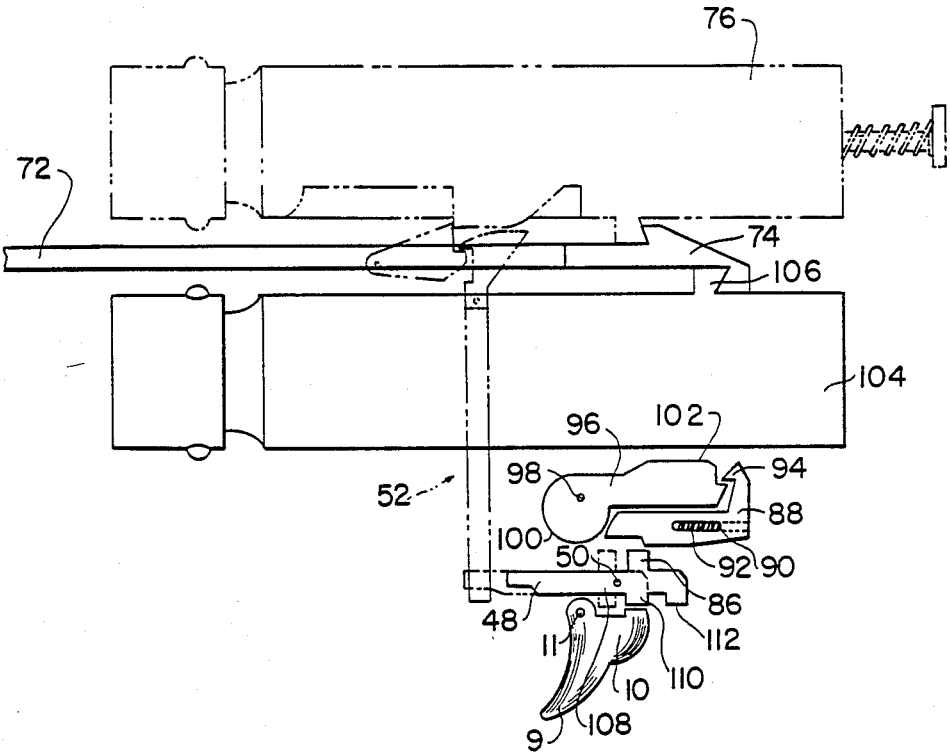
FIG. 4 is a side view of a portion of the selector means for operating the second bolt.

Upon moving the selector switch 8 to a second position, first and second selection switch gears 38 and 40 are rotated so as to move the fire selection group housing means 44 to a position where the sear activator means 48 will be moved from the dotted line to the solid line position of FIG. 4. In this position, when trigger 9 is rotated about pivot 11, the trigger contact surface 10 will engage a sear activator contact point 110. This engagement will cause the sear activator means 48 to rotate about 50 thus resulting in a sear activator protrusion 86 engaging the forward portion of the lower action sear 88. As indicated in FIG. 4, when the sear activator means 48 moves from the dotted line position to the solid line position, the upper sear release bar 52 is no longer engaged by the sear activator means 48 such that pulling of the trigger will not activate the upper action sear 62.

Figure 8:
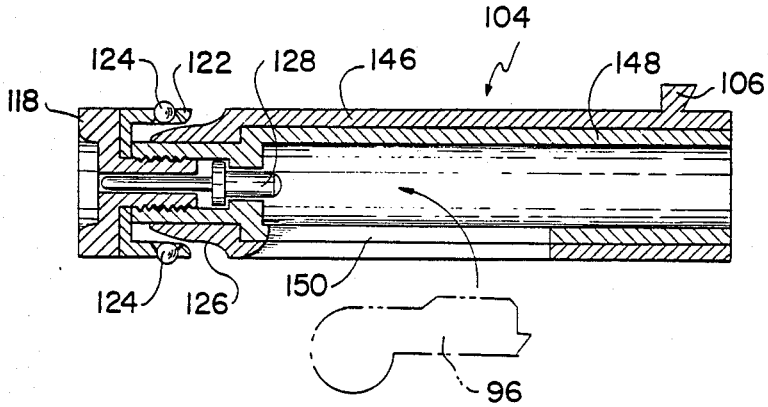
FIG. 8 is a cross-sectional view of the second bolt.

When the forward portion of the lower action sear 88 is engaged by protrusion 86, the lower action sear 88 will pivot about point 90. This pivoting causes the catch 94 to disengage from the hammer 96 whereby the hammer will pivot in the counter-clockwise direction about pivot 98 causing the striking surface 102 of hammer 96 can strike a firing pin 128 as seen in FIG. 8 and as will be described hereinbelow Pivoting of the hammer 96 in the counter-clockwise direction causes a camming surface 100 of the hammer to engage the lower action sear. This engagement causes the sear 88 to be forced rearwardly against the biasing of internal spring 92. As the lower action sear 88 moves rearwardly, this sear will become disengaged from the protrusion 86 and will be allowed to pivot in a counter-clockwise direction about point 90. Thus, the catch 94 may assume a position wherein the hammer may be re-engaged thereby. Movement of the second or lower bolt 104 in a rearward direction will cause the hammer 96 to pivot in a clockwise direction whereby the catch 94 of the lower action sear 88 will re-engage this hammer. This rearward movement of the lower bolt will be discussed below.

As discussed above, movement of selector switch 8 will cause the trigger 9 to release either the upper action sear 62 or the lower action sear 88. This selector switch 8 can thereby be used by an operator to selectively choose which bolt will be fired. This selector switch 8 may also be moved to a safety position whereat neither bolt is capable of being fired.

This safety position is not shown but should be readily understood. Movement of selector switch 8 to a third position moves the fire selection group housing means 44 and the associated sear activator means 48 to a position whereat the pulled trigger will cause trigger contact surface 10 to engage the sear activator neutral position 108 as indicated in FIG. 4. When trigger contact surface 10 engages position 108, the sear activator means 48 will not pivot and neither upper action sear 62 or lower action sear 88 will be engaged. Thus, the selector switch 8 may be moved to prevent firing of ammunition when the trigger 9 is pulled.

It should be noted that in FIG. 2, a first or upper bolt 76 and a second or lower bolt 104 are shown but are merely indicated by cylindrical objects. This showing in FIG. 2 is for reference and the details of the bolts will now be described.

Figure 5:
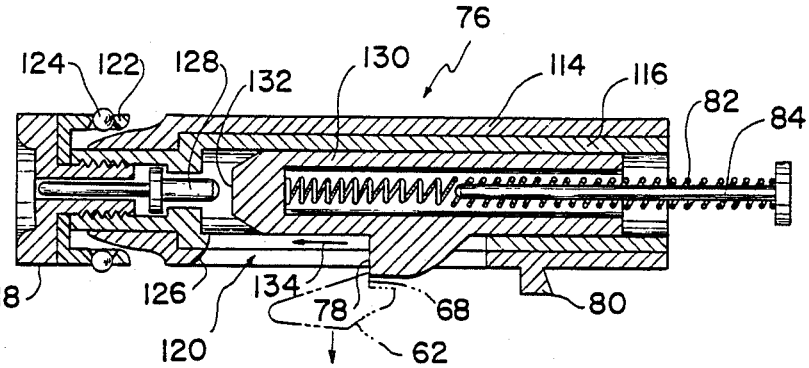
FIG. 5 is a cross-sectional view of the first bolt.

Referring to FIGS. 5 through 8, the firing of the bolts 76 and 104 will now be described. In particular, FIG. 5 shows the first or upper bolt 76. This upper bolt includes a bolt housing 114 and an inner bolt element 116. Both the housing 114 and element 116 surround the striker 130. The upper action sear 62 is indicated in dotted lines in FIG. 5. Further, the face 78 of the striker is indicated as well as an aperture or opening 120 in the upper bolt for forward and rearward movement of this striker face 78.

Forwardly of the bolt housing 114, a forward bolt element 118 is provided. This forward bolt element 118 has openings 122 therein. These openings encircle the bolt element 118 and hold bolt lock-up bearings 124. These bearings may move radially inwardly or outwardly but cannot pass through the openings 122. The camming surface 126 of bolt housing 114 will normally force these bearings 124 outwardly. However, when the bolt housing 114 is moved rearwardly, these bearings can move radially inwardly as will be described hereinbelow.

Upon pivoting of the upper action sear 62 as described above, the face 78 of the striker is released from the engagement portion 68 of sear 62. The upper action spring 82 will then force the striker 130 forwardly as indicated by arrow 13. This movement causes the striker end 132 to strike the firing pin 128. This firing pin 128 will then cause ammunition loaded in the chamber 140 to be fired therefrom. This chamber 140 is shown in FIG. 6 and is adjacent to an internal bore 144.

Figure 6:
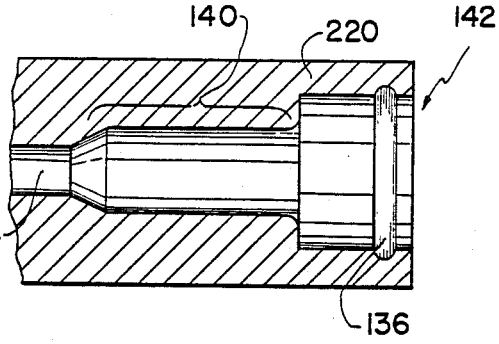
FIG. 6 is a cross-sectional view of the barrel showing the locking groove.
Figure 7:
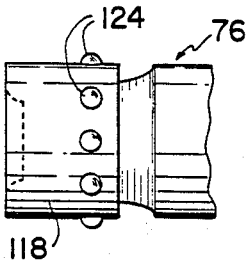
FIG. 7 is a side view of the forward bolt element for either the first or second bolt.

The arrangements shown in both FIG. 6 and 7 are generic to both the first and second bolts. The barrel includes a locking groove 136 for receiving the bolt lock-up bearings 124. When these bearings 124 are pushed radially outwardly by the bolt housing 76, they will engage the locking groove 136 and prevent rearward movement of either bolt. However, after firing of the ammunition from the chamber 140, a bolt selection block 74 will engage either the upper bolt lug 80 or the lower bolt lug 106 and force the respective bolt rearwardly. Movement of the bolt lug 80 of the first or upper bolt 76 will cause the bolt housing 114 to move rearwardly. The lock-up bearings 124 may then move inwardly and become disengaged from the locking groove 136. The remaining portions of the upper bolt 76 are then free to move rearwardly. Thus, the bolt housing 114, inner bolt element 116, forward bolt element 118 and striker 130 may all be moved rearwardly. An opening 142 is then provided between the bolt and chamber 140 whereby the feeder means 13 may insert ammunition as will be described below. After the striker 130 has been moved rearwardly, the upper action sear 62 is provided to re-engage the face 78 of this striker to hold it in the rearward position.

Operation of the second or lower bolt 104 as seen in FIG. 8 is similar to that as shown in FIG. 5. In particular, a lower bolt lug 106 is provided as well as a bolt housing 146 and inner bolt element 148. This lower bolt 104 does not have a striker as does the upper bolt 76. Instead, the lower bolt 104 uses a hammer 96 to engage the firing pin 128 in order to fire the ammunition from the chamber 140. An opening 150 is provided in the lower bolt 104 whereby hammer 96 may pivot to strike the firing pin 128. Thus, a chamber 140 and locking groove 136 are provided for both the first or upper bolt 76 and second or lower bolt 104.

A forward bolt element 118 with apertures 122 and bolt lock-up bearings 124 is also provided for the second or lower bolt 104. The lower bolt 104 may then be operated whereby the hammer 96 will strike the firing pin 128 in order to fire ammunition from the chamber. The lower bolt lug 106, being engaged by the bolt selection block means 74 as will be described below, will be moved rearwardly. Rearward movement of the bolt 106 causes the lower bolt housing 146 to move rearwardly and permits the lock-up bearings 124 to move radially inwardly. This movement releases the forward portion 118 of the bolt from the locked position with locking grooves 136 whereby the entire lower bolt assembly 104 may move rearwardly. This rearward movement of the lower bolt 104 will cause the hammer 96 to pivot in a clockwise direction and return to its initial position whereby the lower action sear 88 may catch and hold this hammer 96 in position.

Figure 9:
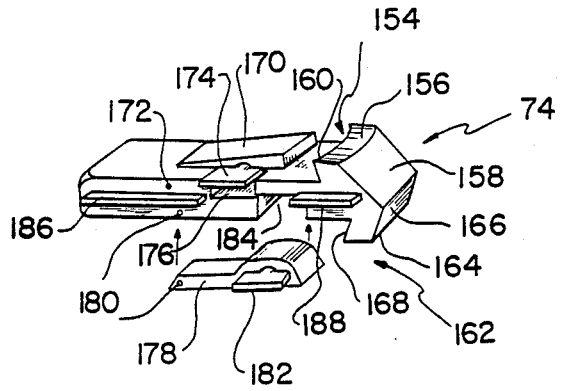
FIG. 9 is a side sectional oblique view of the bolt selection block with the second bolt activator partially removed.

Referring to FIGS. 2 and 9, the bolt selection block means 74 will now be described. This bolt selection block means 74 is operatively connected to both the gas tube 34 and action rods 72 as seen in FIG. 2. These action rods 72 are contained within the housing 32 seen in FIG. 1. Movement of the forestock 28 in the rearward direction will initially cause the bolt selection block 74 to be moved rearwardly. However, when ammunition is fired from either chamber, the gas port block 36 will capture some of the gas generated during this firing and will funnel this gas through gas tube 34 into gas tube inlet 152 of block 74 seen in FIG. 2. This gas will force the selection block 74 to move rearwardly. Thus, the forestock 28 may be initially pumped in order to first load ammunition into one of the chambers as will be described hereinbelow. After this initial loading, the ammunition will be automatically loaded as the bolt selection block 74 is automatically moved rearwardly via the action of the gas tube 34.

The bolt selection block means 74 as shown in FIG. 9 includes an upper bolt lug catch 154 with a curved top surface 156, a sloped rear surface 158 and a catch surface 160. A lower bolt lug catch 162 is also provided with a curve lower surface 164, a sloped rear surface 166 and a catch surface 168. The curved top surface 156 and curved lower surface 164 are shaped so as to conform to the shape of the respective upper and lower bolts 76, 104 whereby the bolt selection block means 74 can readily slide therebetween without requiring a lot of space.

The bolt selection block 74 includes a first or upper bolt activator 170. This bolt activator is pivotable about point 172. A first or upper bolt activator guide 174 is provided on each side of the bolt activator 170. An opening 176 is provided in block means 74 for receiving this guide 174. The block means 74 also includes a second or lower bolt activator 178 which is pivotable about point 180. This lower or second bolt activator 178 is shown removed from the block means 74 in FIG. 9 merely to facilitate understanding of this second or lower bolt activator 178. A second or lower bolt activator guide 182 is provided on each side of the second or lower bolt activator 178. Furthermore, an opening 184 is provided in block 174 for receiving the activator guide 182. The block means 74 further includes on each side a forward guide 186 and a rearward guide 188.

Figure 10:
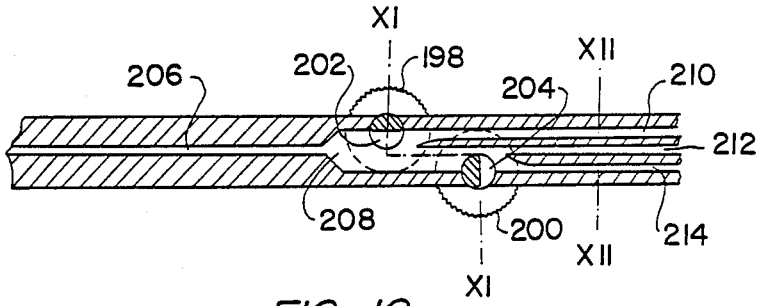
FIG. 10 is a side sectional view of the guide means.
Figure 11:
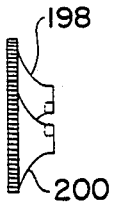
FIG. 11 is a cross-sectional view of FIG. 10 taken along line XI—XI.
Figure 12:
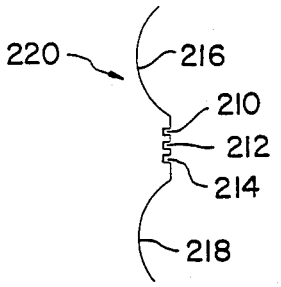
FIG. 12 is a cross-sectional view of FIG. 10 taken along line XII—XII.

Referring to FIGS. 10 through 12, operation of the block means 74 will be described. The various guides 186, 174, 182 and 188 will be forwardly and rearwardly movable with the forward and rearward movement of block means 74. This forward and rearward movement of block means 74 is caused by either the movement of the action rod 72 by the forestock 28 or through the gas tube 34 as previously described. As the block 74 moves forwardly and rearwardly, the guides 186, 174, 182 and 188 will slide along various guide paths. In particular, in FIG. 10, a forward guide path 206, an intermediate guide section 208, an upper guide section 210, a central guide section 212 and a lower guide section 214 are shown. These guide sections are formed by the inner surface of the receiver 220 between the bolt positions. The upper 210, central 212 and lower 214 guide sections are further indicated in FIG. 12 along with the receiver surface 216 for the upper bolt 76 and receiver surface 218 for the lower bolt 104. Further, a second upper action cam gear 198 and second lower action cam gear 200 are indicated in both FIGS. 10 and 11 and will now be described.

As seen in FIG. 2, only the second upper action cam gear 198 is shown. A corresponding first upper action cam gear 194 and first lower action cam gear 196 are also indicated in FIG. 2 (however, these first cam gears 194, 196 are not shown in FIG. 10). These various cam gears are interconnected to the first and second selection switch gears 38, 40 through first action selection transfer bar 190 and second action selection transfer bar 192, respectively. Movement of the selector switch 8 to rotate the selection gears 38, 40 will cause these action selection transfer bars 190, 192 to reciprocate simultaneously with the movement of the fire selection group housing means 44. It should be noted that the upper and lower ends of both of these bars are cut at an angle whereby movement of these bars will not interfere with the receiver.

When the action selection transfer bars 190, 192 are reciprocated, the corresponding cam gears 194, 196, 198 and 200 will be rotated. As seen in FIG. 10, the selection switch 8 has been moved whereby the upper bolt will be activated. In this manner, the first and second upper action cam gears 194, 198 will be rotated to a position wherein the entrance to the upper guide section 210 is open. Thus, when the bolt selection block 74 moves rearwardly by action of the action rod 72 or gas tube 34, the first bolt activator 170 will be in the open position, assisted by an internal spring (not shown). This first bolt activator 170 will remain in the raised position as the guide 174 continues to move rearward along the guide surface 202 of gear 198 and along upper guide section 210. Thus, the guide 174 will assume a raised position or a position flush with the surface of bolt selection block means 74. Likewise, the lower or second bolt activator 178 may pop out to be in a raised position (projecting downwardly) due to an internal spring (not shown) or may be flushed with the surface of the bolt selection block means 74. In the FIG. 10 position for gears 198, 200, the upper bolt activator guide 174 will not be forced into the central guide section 212 but will be free to travel along the upper guide section 210 as the bolt selection block means 74 moves rearwardly.

When this upper bolt activator guide 174 travels along the upper guide section 210, the upper bolt activator 170 will remain in a raised position as indicated in FIG. 9. In this raised position, the upper bolt activator 170 is free to engage the forward face of the upper bolt lug 80. Thus, as the selection block means 74 continues to move rearwardly, engagement of the upper bolt activator 170 with the bolt 80 will force the upper bolt 76 rearwardly. However, as the first and second lower action cam gears 196, 200 are in a position as indicated in FIG. 10, the lower bolt activator guide 182 will be forced along the central guide section 212. Thus, the lower bolt activator 178 will remain pressed into the bolt selection block means 74 and will not engage the bolt lug 106 of the lower bolt 104. Accordingly, only the upper bolt will be moved in the rearward direction by the bolt selection block means 74 when the upper and lower action cam gears 198, 200 are in the position as indicated in FIG. 10. It should be noted that the corresponding first upper and lower action cam gears 194, 196 move simultaneously with the second upper and lower action cam gears 198, 200 and would therefore be positioned similarly.

When the selector switch 8 is moved to a second position, the first and second action selection transfer bars 190, 192 will move so as to rotate the various upper and lower action cam gears 194, 196, 198, 200. Thus, it can be seen in FIG. 10 that if the upper action cam gear 198 will rotate 90° and the lower action cam gear 200 will rotate 90°, the upper guide section 210 would be blocked while the lower guide section 214 would be opened to receive the lower bolt activator guide 182 of the lower bolt activator 178. This lower guide 182 would slide through the intermediate guide section 208, over the guide surface 204 of gear 200 and along the lower guide section 214. Thus, this lower bolt activator 178 would engage the bolt lug 106 of the lower bolt 104 and move this lower bolt 104 rearwardly. In this position, only the lower bolt 104 would be moved rearwardly while the upper bolt would not be moved.

Additional movement of the selector switch 8, can further adjust the first and second action selection transfer bars 190, 192 to further move the various action cam gears 194, 196, 198 and 200 whereby both the upper guide section 210 and lower guide section 214 will be blocked. In this situation, the upper bolt activator guide 174 and lower bolt activator guide 182 will both travel along the central guide section 212. In this arrangement, both the upper bolt activator 170 and lower bolt activator 178 will be pressed into the bolt selection block 74 such that neither bolt lug 80 of the upper bolt 76 or bolt lug 106 of the lower bolt 104 will be engaged. In this position, neither bolt will be moved and the gun is thus in a safety mode. Thus, if the forestock were pumped in this position, neither bolt would be loaded.

Figure 13:
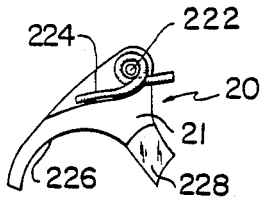
FIG. 13 is an end view of a first action ammunition feeder.
Figure 14:
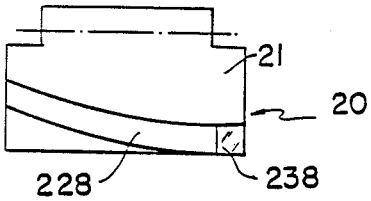
FIG. 14 is an inside view of the first action ammunition feeder.
Figure 15:
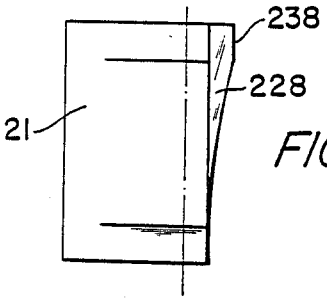
FIG. 15 is a top view of the first action ammunition feeder.
Figure 16:
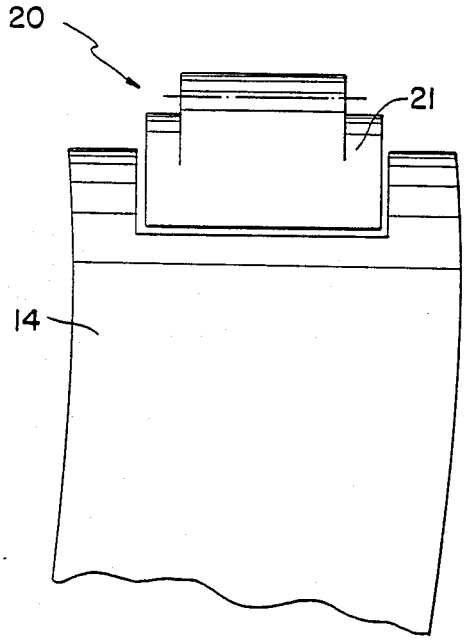
FIG. 16 is an outside view of the first action ammunition feeder in relation to the first magazine.
Figure 17:
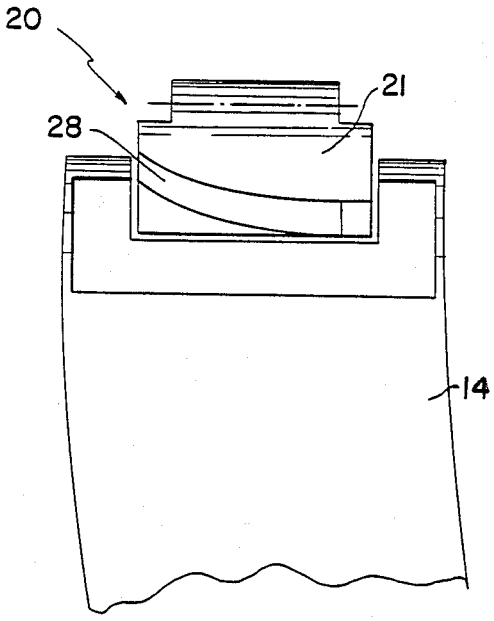
FIG. 17 is an inside view of the first action ammunition feeder in relation to the first magazine.

Referring to FIGS. 13 through 17, loading of the ammunition by the feeder means 13 will now be described. As can be seen in FIG. 13, the upper action ammunition feeder 20 is provided. This upper action feeder 20 includes a camming insertion element 21 having a spring 224 for pivoting the insertion element 21 in a counter-clockwise direction about pivot 222. A shell receiving portion 226 is also provided on the camming insertion element 21 as well as a cammed surface 228. This camming insertion element 21 will be placed above the shotgun magazine 14 as indicated in FIGS. 16 and 17. Again, this magazine 14 could hold any desired type of ammunition.

Figure 18:
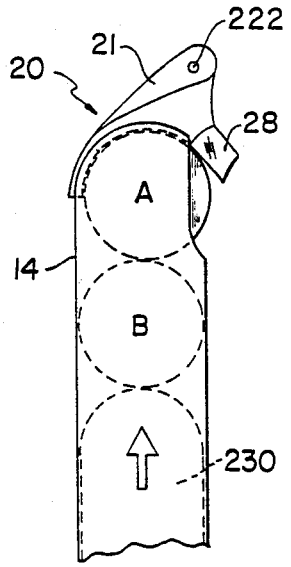
FIG. 18 is an end view of the first action ammunition feeder prior to feeding of the first round of ammunition.
Figure 19:
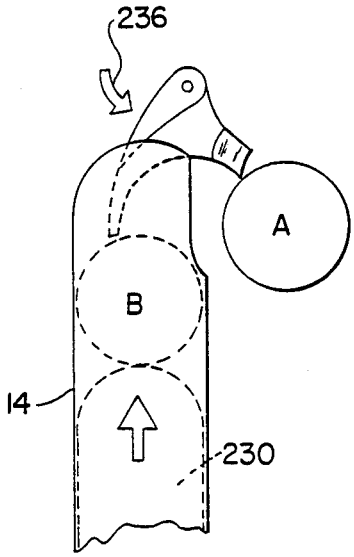
FIG. 19 is an end view of the first action ammunition feeder during feeding of the first round of ammunition.

As seen in FIGS. 18 through 19, a means 230 is provided for upperwardly biasing various shells A, B, within the shotgun magazine 14. While only two shells A, B are shown, it should be understood that a plurality of shells could be used. As the shell A is forced upwardly by means 230, this shell A will engage the shell receiving portion 226 of the camming insertion element 21. The camming surface 228 of the camming insertion element 21 will normally engage the first or upper bolt 76 and thereby be held in the position shown in FIG. 18.

Figure 20:
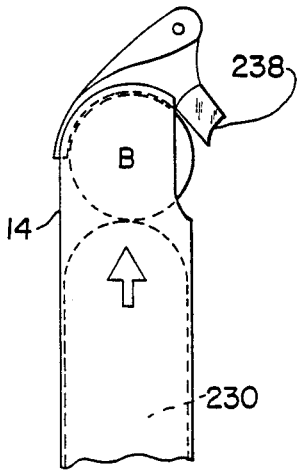
FIG. 20 is an end view of the first action ammunition feeder after feeding of the first round of ammunition.

However, when the first or upper bolt 76 is moved rearwardly as described above, the spring 224 will cause the camming insertion element 21 to move in the direction as indicated by arrow 236. This movement will insert the shell A at a position adjacent the first chamber 140. Return forward movement of the first or upper bolt 76 will engage the cammed surface 228 of the camming insertion element 21 and return this element 21 to the position shown in FIG. 20. It should be noted in FIG. 19 that the end portion of the extended camming insertion element 21 prevents the second shell B from moving to a position whereby it may be introduced through an opening in the magazine. The camming insertion element 21 will return to the FIG. 20 position whereat the shell B will abut the shell receiving portion 226.

Upon the firing of the first or upper bolt 76, the camming insertion element 21 is moved in the direction of arrow 236. Thus, loading of shells to the shotgun may be automatically carried out.

The rifle magazine 12 shown in FIG. 1 is held by the feeder means 13 adjacent the shotgun magazine 14. This rifle magazine 12 may have rounds of ammunition discharged from an upper surface therein. Furthermore, while the magazine 14 has been described as holding shotgun shells, it should be understood that this feeder means may be modified to accomodate a second type of ammunition.

Figure 21:
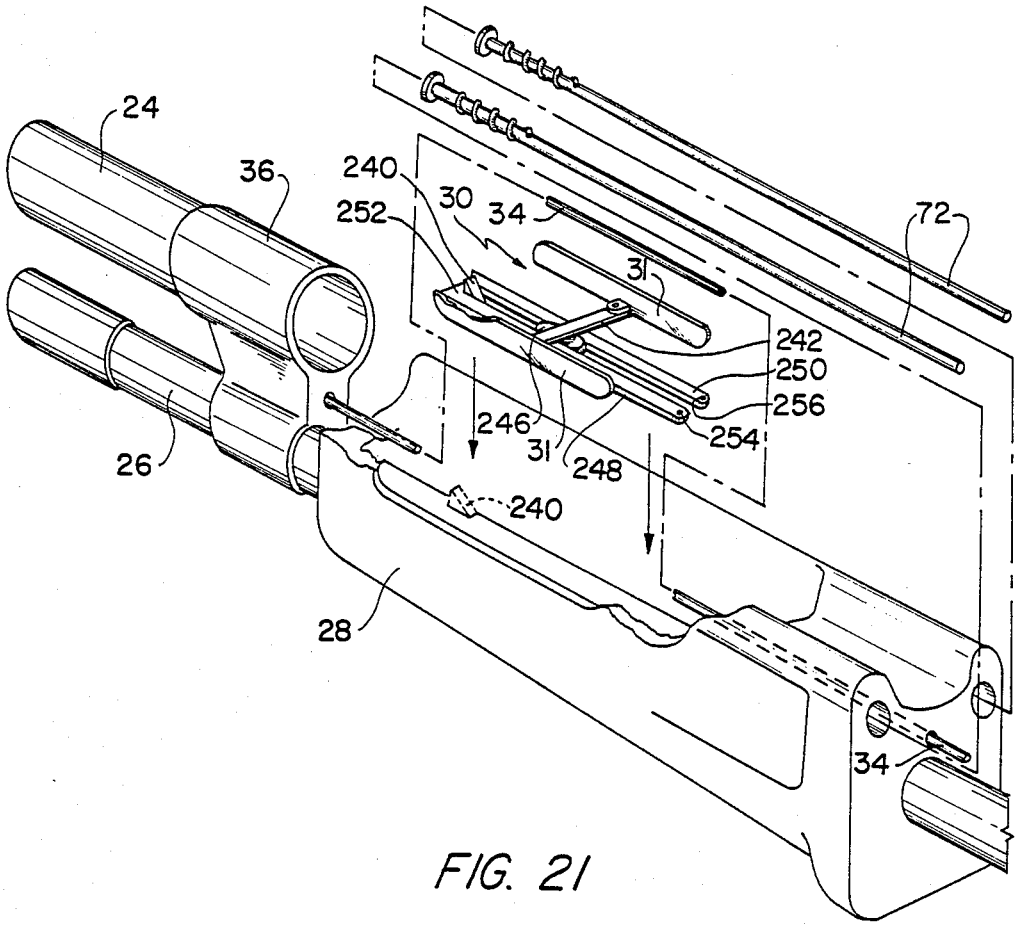
FIG. 21 is an exploded view of the forestock and forestock lock release.

Referring now to FIG. 21, the forestock 28 and forestock siding lock release 30 will now be described. This sliding lock release 30 is engageable with a forestock detent 240 which is stationary relative to the shotgun barrel 24 and rifle barrel 26. An intermediate slide release bar 242 extends between two forestock lock release elements 31. Only one of these elements need be operated by an operator in order to release the forestock. Operation of these elements 31 is simply carried out by the operator placing a thumb or forefinger on the lock release element 31 and sliding one of these elements forwardly. This forward movement causes the intermediate slide release bar 242 to pivot.

Movement of the intermediate slide release bar 242 results in spreader means 246 rotating. This spreader means 246 will engage a first and second release bar 248, 250. Each release bar has a forestock detent catch 252. When these bars 248, 250 are engaged by the spreader means 246, they will pivot about their respective pivots 254, 256. Such pivoting releases the various catches 252 from the forestock detent 240 and then allows the forestock to move to a rearward position. Release of the engaged forestock lock release element 31 will cause the intermediate slide release bar 242 to return to its initial position and will cause the spreader means to 246 to be aligned such that the first and second release bars 248, 250 will return to their first positions for re-engagement with the forestock detent 240. The forward end of the first and second release bars 248, 250 is cammed such that it may snap over the detent 240 when the forestock 28 returns to the forward position.

The present invention thus provides for a semiautomatic gun which may be easily operated and manufactured. This gun may fire either a rifle or a shotgun round or any other selected round of ammunition. This arrangement permits an operator to keep his or her hands in the firing position and can be carried with no round in the chamber to therefore improve its safety. The instant invention avoids jamming of the gun and provides for effective and efficient firing. The instant invention provides for easy selection of the type of ammunition to be fed and fired and can be easily and economically manufactured and maintained.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A semiautomatic gun comprising:

a first chamber and a first bolt, said first bolt firing a first type of ammunition from said first chamber;

a second chamber and second bolt, said second bolt firing a second type of ammunition from said second chamber;

a trigger;

selector means for enabling said trigger to selectively fire one of said first bolt and said second bolt, said selector means further comprising:

a movable switch operable by a user of said gun for selecting one of said bolts, sear activator means for selectively interengaging a portion of said trigger to one of said bolts, said sear activator means having at least three surfaces engageable with said portion of said trigger when said trigger is pulled, the first surface of said sear activator means preventing firing of any of said bolts when said trigger is pulled, said second surface being engageable by said portion of said trigger and permitting said first bolt to be fired, said third surface being engageable by said portion of said trigger and permitting said second bolt to be fired, and housing means for containing and reciprocating said sear activator means, said housing means being reciprocated by movement of said switch whereby said sear activator means is reciprocated in order for said portion of said trigger to be engageable with one of said three surfaces when said trigger is pulled; and feeder means for supplying said first and second types of ammunition to said chambers.

2. The semiautomatic gun as recited in claim 1 wherein said first chamber and said first bolt are both located above both of said second chamber and said second bolt.

3. The semiautomatic gun as recited in claim 2 further comprising a sear release bar extending from said sear activator means along a side of said second bolt and to a position adjacent said first bolt, said sear release bar being vertically reciprocated when said trigger is pulled and after said switch moves said housing means to place said sear activator means in a position wherein said second surface is engaged with said portion of said trigger.

4. The semiautomatic gun as recited in claim 3 wherein said sear release bar further comprises a pivoting head portion and wherein said semiautomatic gun further comprises:

an upper action sear:

a firing pin within said first bolt for shooting said first type of ammunition from said first chamber when said bolt is fired; and a striker contained in said first bolt, said striker being longitudinally reciprocable and having a striker face which is normally engaged and held in a prefiring position by said upper action sear, said striker being spring biased to move toward said firing pin whereby when said sear release bar vertically reciprocates upon pulling of said trigger, said striker is released from engagement with said upper action sear and said striker face moves due to the spring biasing toward and into engagement with said firing pin whereafter said first type of ammunition is shot from said gun.

5. The semiautomatic gun as recited in claim 4 wherein said first bolt further comprises:

a bolt housing which surrounds said striker and said firing pin, said bolt housing being reciprocable, said bolt housing moving rearwardly after shooting of said first type of ammunition;

a forward bolt element which surrounds a forward portion of said bolt housing and has a plurality of apertures therein;

bolt lock-up bearings housed between said forward portion of said bolt housing and said forward bolt element, said bearings normally being engaged by said forward portion of said bolt housing and being forced radially outward into engagement with a locking groove thereby, said lock-up bearings holding said first bolt in a prefiring position when engaged in said locking groove, said bearings moving radially inwardly when said bolt housing moves rearwardly thereby releasing said first bolt to permit said first bolt to move rearwardly and to permit additional first types of ammunition to be supplied to said first chamber by said feeder means.

6. The semiautomatic gun as recited in claim 5, further comprising:

bolt selection means responsive to said selector means for at least moving said first bolt in the rearward direction after shooting of said first type of ammunition, said bolt selection means further moving said second bolt in the rearward direction depending upon movement of said switch of said selector means; and guide means for guiding said bolt selection means whereby said bolt selection means reciprocates along a selected path.

7. The semiautomatic gun as recited in claim 1, further comprising:

a lower action sear having a catch portion and being spring biased in the forward direction;

a hammer being spring biased to pivot in a forward direction, said hammer being held in a prefiring position by said catch portion of said lower action sear prior to pulling of said trigger; and a firing pin contained within said second bolt for shooting said second type of ammunition from said second chamber after said trigger is pulled;

whereby movement of said switch to interengage said portion of said trigger with said third surface of said sear activator means enables said sear activator means to pivot said lower action sear whereafter said hammer is disengaged from said catch portion and pivots in said forward direction to strike said firing pin to shoot said second type of ammunition from said second chamber.

8. The semiautomatic gun as recited in claim 7, wherein said hammer further comprises a camming surface which engages said lower action gear as said hammer pivots in said forward direction whereby said lower action sear disengages from said sear activator means to pivot in a direction opposite that in which said lower action sear pivoted when said trigger was pulled.

9. The semiautomatic gun as recited in claim 8, further comprising bolt selection means responsive to said selector means for at least moving said second bolt in a rearward direction, said hammer returning to said prefiring position by engagement with the second bolt as said second bolt moves rearwardly whereafter said lower action sear moves in the forward direction due to said spring biasing in order for said catch portion to re-engage said hammer and hold said hammer in said prefiring position.

10. A semiautomatic gun comprising:

a first chamber and a first bolt, said first bolt firing a first type of ammunition from said first chamber;

a second chamber and second bolt, said bolt firing a second type of ammunition from said second chamber;

a trigger;

selector means for enabling said trigger to selectively fire one of said first bolt and said second bolt;

feeder means for supplying said first and second types of ammunition to said chambers;

bolt selection means responsive to said selector means for selectively engaging one of said bolts in response to said selector means selecting a bolt, said bolt selection means engaging a same bolt as that selected by said selector means, said bolt selecting means being reciprocable and moving the selected bolt rearwardly when engaged therewith; and guide means for guiding said bolt selection means during reciprocation.

11. The semiautomatic gun as recited in claim 10, wherein said bolt selection means further comprises a first bolt activator guide and a second bolt activator guide, each of said first and second bolt activator guides being engageable with said guide means, said first and second bolts each having a bolt lug and said bolt selection means also further comprising a first and a second bolt activator, said first bolt activator being selectively engageable with said first bolt lug in order to move said first bolt rearwardly when said bolt selection means moves rearwardly and said second bolt activator being selectively engageable with said second bolt lug in order to move said second bolt rearwardly, said bolt selection means being moved rearwardly at least after one of a first and second types of ammunition is fired from said gun.

12. The semiautomatic gun as recited in claim 11, wherein said guide means comprise at least an upper guide section, a central guide section, and a lower guide section, said first bolt activator guide being selectively movable along one of the upper guide and central guide sections, said second bolt activator guide being selectively movable along one of the central and lower guide sections, said first bolt activator guide being movable along said upper guide section only when said second bolt activator guide moves along said central guide section, said second bolt activator guide being movable along said lower guide section only when said first bolt activator guide moves along said central guide section, said first and said second bolt activator guides both being selectively movable along the central guide section in order to prevent engagement of either bolt lug by either said first and said second bolt activators.

13. The semiautomatic gun as recited in claim 12, wherein said selector means further comprises:

a movable switch operable by a user of said gun for selecting one of said bolts;

at least one action selection transfer bar operatively connected to said switch; and at least upper and lower action cam gears, said gears each being pivotable by movement of said switch to thereby permit one of said first bolt activator guide and said second bolt activator guide to move along one of said upper guide section and said lower guide section whereby movement of said switch selects which bolt will be moved rearwardly after firing of said gun, whereafter said feeder means can resupply the bolt which is fired with ammunition.

14. The semiautomatic gun as recited in claim 10, wherein said gun further comprises;

a first barrel adjacent said first bolt through which said first type of ammunition travels after being fired;

a second barrel adjacent said second bolt through which said second type of ammunition travels after being fired;

gas tube means for interconnecting said first and second barrels to said bolt selection means whereby firing of said gun causes gas to move through said gas tube means and forces said bolt selection means rearwardly to thereby permit automatic reloading of the chamber which is fired.

15. The semiautomatic gun as recited in claim 10, wherein said gun further comprises:

a reciprocable forestock located forwardly of said first and second chambers; and spring action rods connecting said forestock to said bolt selection means whereby movement of said forestock in said rearward direction moves said bolt selection means in said rearward direction to permit introduction of ammunition to one of said chambers by said feeder means provided said selector means has selected a bolt, said spring action rods being spring biased in said forward direction such that an operator pulls said forestock rearwardly to initially load one of said chambers.

16. The semiautomatic gun as recited in claim 15, wherein said forestock further comprises a forestock lock release for selectively locking and releasing said forestock to permit rearward movement, said forestock lock release comprising:

two forestock lock release elements, one of said forestock release elements being located on a side of said forestock while another of said forestock release elements being located on an opposite side of said forestock, each of said forestock lock release elements being selectively operable by a user of said gun;

a detent fixedly attached to a barrel of said gun;

at least one release bar attached to said forestock and having a catch for engaging said detent to thereby prevent movement of said forestock;

an intermediate slide release bar extending between said lock release elements; and spreader means attached to said intermediate slide release bar for separating said catch of said at least one release bar from said detent to thereby permit rearward movement of said forestock, said spreader means being actuated when one of said two forestock lock release elements is operated by a user of the gun.

17. A semiautomatic gun comprising:

a first chamber and a first bolt, said first bolt firing a first type of ammunition from said first chamber;

a second chamber and second bolt, said second bolt firing a second type of ammunition from said second chamber;

a trigger;

selector means for enabling said trigger to selectively fire one of said first bolt and said second bolt, said selector means further comprising;

a movable switch operable by a user of said gun for selecting one of said bolts, sear activator means for selectively interengaging a portion of said trigger to one of said bolts, said sear activator means having at least three surfaces engageable with said portion of said trigger when said trigger is pulled, the first section of said sear activator means preventing firing of any of said bolts when said trigger is pulled, said second surface being engageable by said portion of said trigger and permitting said first bolt to be fired, said third surface being engageable by said portion of said trigger and permitting said second bolt to be fired, and housing means for containing and reciprocating said sear activator means, said housing means being reciprocated by movement of said switch whereby said sear activator means is reciprocated in order for said portion of said trigger to be engageable with one of said three surfaces when said trigger is pulled;

bolt selection means responsive to said selector means for selectively engaging one of said bolts in response to said selector means selecting a bolt, said bolt selection means engaging a same bolt as that selected by said selector means, said bolt selection means being engaged therewith;

guide means for guiding said bolt selection means during reciprocation; and feeder means for supplying said first and second types of ammunition to said chambers, said feeder means further comprising;

a first magazine well for receiving a first magazine containing said first type of ammunition, first action insertion means for moving individual rounds of said first type of ammunition from said first chamber, each of said rounds being moved at least in a generally horizontal, lateral direction by said first action insertion means, and a second magazine well located adjacent said first magazine well for receiving a second magazine containing said second type of ammunition.

* * * * *